US005965854A

United States Patent [19]

Umemura

[11] Patent Number: 5,965,854

[45] Date of Patent: Oct. 12, 1999

[54] MULTIPLE PUSH-BUTTON SWITCH ASSEMBLY WITH INTERLOCKING MECHANISM

[75] Inventor: Heihachiro Umemura, Sakai, Japan

[73] Assignee: Shinkoh Electric Co., Ltd., Osaka, Japan

[21] Appl. No.: 09/019,983

[22] Filed: Feb. 6, 1998

[30] Foreign Application Priority Data

Feb. 10, 1997 [JP] Japan ..... 9-041692

[51] Int. Cl.[6] ..... H01H 9/26; H01H 13/68

[52] U.S. Cl. ..... 200/5 E; 200/50.33; 200/50.36

[58] Field of Search ..... 200/5 B, 5 C, 200/5 D, 5 E, 50.32, 50.33, 50.36; 74/483 PB

[56] References Cited

U.S. PATENT DOCUMENTS 5,045,647 9/1991 Kato ..... 200/5 E
5,382,836 1/1995 Umemura ..... 307/127
5,473,203 12/1995 Umemura ..... 307/127
5,576,525 11/1996 Umemura ..... 200/520 X
5,646,382 7/1997 Moriya ..... 200/50.33

*Primary Examiner*—J. R. Scott

[57] ABSTRACT

This invention is an interlocking device for a push-button switch in compact size and with a mechanically simple construction, capable of realizing interlocking of a push-button switch having a pair of push buttons facing each other and being downwardly movable in multiple stages by being pressed, while sufficiently securing stroke in each stage of the push buttons. A switch body having a fixed contact is provided with two push buttons, having mobile contacts, facing each other and being downwardly movable in multiple stages. An interlocking member for mobile contact is swingably disposed, for preventing closing of the mobile contact of at least one push button due to touching of the mobile contact the two push buttons are pressed, on the switch body at a position lower than the push buttons, with approximately the mid-point of two push buttons.

6 Claims, 12 Drawing Sheets

| CONTACTS | PUSH-BUTTON SWITCH | | OUTPUT |
|---|---|---|---|
| | 2A | 2B | |
| ① – ② | 0 | 0 / 1 / 2 / 3 | OFF |
| | 1 / 2 / 3 | – | ON |
| ⑤ – ⑥ | 0 / 1 | 0 / 1 | OFF |
| | 2 / 3 | 2 / 3 | ON |
| ⑦ – ⑧ | 0 / 1 / 2 | 0 / 1 / 2 | OFF |
| | 3 | 3 | ON |
| ③ – ④ | 0 / 1 / 2 / 3 | 0 | OFF |
| | – | 1 / 2 / 3 | ON |

0 : no operation
1 : the first stage
2 : the second stage
3 : the third stage
– : nonentity

FIG. 9 (iii)

MULTIPLE PUSH-BUTTON SWITCH ASSEMBLY WITH INTERLOCKING MECHANISM

BACKGROUND OF THE INVENTION

The present invention relates to an interlocking device for a push-button switch used for the operation of cranes and hoists, for example. More specifically, it relates to an interlocking device of a push-button switch including a switch body having fixed contacts provided with two push buttons, having mobile contacts, facing each other and being downwardly movable in multiple stages by being pressed.

On a conventional push-button switch used for the operation of cranes and hoists, an interlocking member for the push button is swingably provided with approximately the mid-point of two push buttons, provided face to face with each other. The interlocking member acts as a fulcrum to prevent simultaneous pressing down of the two push buttons, so that the operator may not press down the two push buttons simultaneously by mistake, causing reckless run or other trouble of the equipment (U.S. Pat. No. 5,045,647).

Also, when the conventional interlocking device for a push-button switch is applied a push-button switch having a pair of push buttons facing each other and being downwardly movable in multiple stages, or in three stages for example, a problem was that, to enable pressing down in three stages of either push button while preventing simultaneous pressing down of the two push buttons, it was impossible to maintain a large degree of freedom of a relative operating range between the two push buttons and the interlocking member due to the structure of this interlocking device, thus making it difficult to maintain a sufficient stroke in each stage of the push buttons and thereby causing a drop of operability of the push buttons.

SUMMARY OF THE INVENTION

The object of the present invention is to provide, in view of the problems of the conventional interlocking devices for push-button switches, a compact-sized interlocking device for push-button switches with a mechanically simple construction, capable of interlocking a push-button switch with a pair of push buttons facing each other and being downwardly movable in multiple stages by being pressed, while sufficiently securing the stroke in each push button stage.

To achieve the object, the interlocking device for push-button switches of this first invention is an interlocking device for a push-button switch realized by providing, on a fixed contact switch body, two push buttons, having mobile contacts, facing each other and being downwardly movable in multiple stages by being pressed. An interlocking mobile contact member, to prevent closing of the mobile contact of at least one push button due to the touching of the mobile contact of the push button when both buttons are pressed down, is provided with a swinging interlocking part at a position lower than the two push buttons, connected at approximately the mid-point f the two push buttons.

This interlocking device for push-button switches, designed to interlock a push-button switch having a pair of push buttons facing each other and being downwardly movable in multiple stages, by means of an interlocking member for mobile contact, for preventing closing of the mobile contact of at least one push button due to the touching of the mobile contact of the push button the two push buttons are pressed down, can secure a larger relative operating range freedom between the two push buttons and the interlocking member for push buttons and can therefore secure a sufficient stroke in each push button stage, thus improving the operability of the push buttons.

In this case, the interlocking member for mobile contact, to prevent closing of the mobile contact of at least one push button due to the touching of the mobile contact of the push button when both of the two push buttons are pressed, may be provided in a way that it swings on the switch body at a position lower than the two push buttons, connected at approximately the mid-point of the two push buttons.

Due to the interlocking member for mobile contact, any simultaneous pressing down by no less than two stages of the two push buttons can be prevented, thereby making it possible, in the case of any operation that requires simultaneous pressing down of the two push buttons, for the push button opened by the action of the interlocking member for mobile contact to cancel the pressing down operation of the other push button, so as to prevent any sudden closing of that other push button in the pressed down state by no less than two stages, thus accurately preventing any reckless operating or other trouble with the equipment.

Moreover, by preventing simultaneous pressing down by no less than two stages of the two push buttons, it becomes possible to prevent the application of any large external force to the interlocking member for push buttons, and improves the durability of the interlocking member for push buttons which shall preferably be formed from a synthetic resin material.

In this case, the interlocking member for push-button, constructed in such a way that the push button touches its contact point when the push button is pressed down by no less than two stages, does not exhibit the defect of an interlocking member for push buttons which cannot secure a large relative operating range freedom, and can secure a sufficient stroke in each of the push button stages.

Furthermore, to achieve the same objective, the interlocking device for push-button switches of the second invention is an interlocking device of a push-button switch realized by providing, on a switch body with a fixed contact, two push buttons, having a mobile contact, facing each other and being downwardly moveable in multiple stages by being pressed. Interlocking members for push buttons, which synchronizingly swing with the pressing down of the push buttons when the push buttons are pressed downward, are provided facing each other, in correspondence to the two push buttons respectively. A projection is formed on one interlocking member to prevent the other interlocking member from swinging, thus preventing any simultaneous pressing down of the two push buttons.

This interlocking device for push buttons, designed to realized interlocking of a push-button switch having a pair of push buttons facing each other and being downwardly movable in multiple stages by being pressed, by means of an interlocking member for a push button swinging in synchronization with the pressing down of push buttons when the two push buttons are pressed downward, can secure a large relative operating range freedom and can, therefore, secure a sufficient stroke in each push button stage, thus improving the operability of push-button switches.

DETAILED DESCRIPTION OF THE INVENTION

Figure 1:
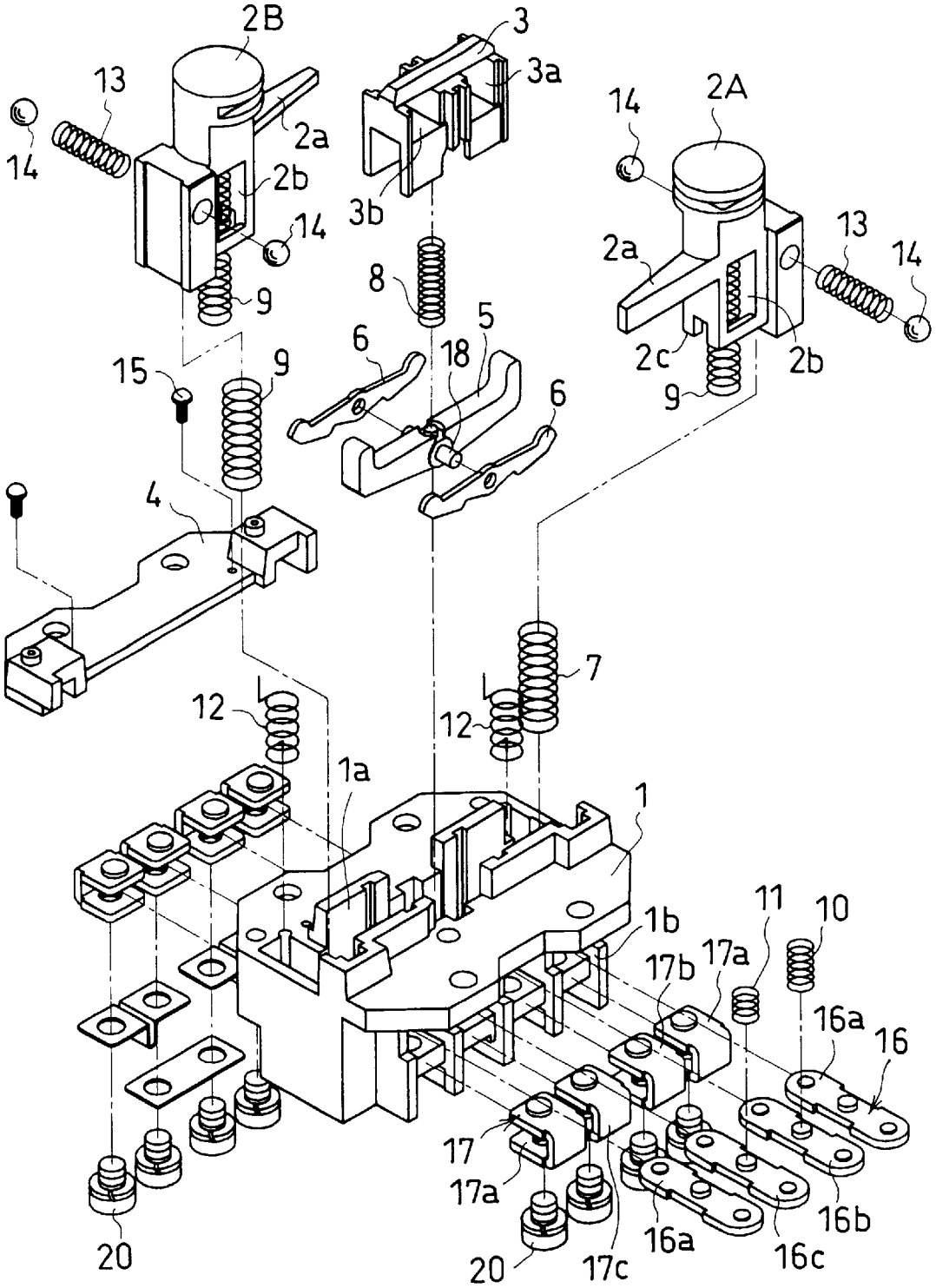
FIG. 1 is an exploded perspective view showing the first embodiment of a push-button switch including the interlocking device according to the present invention.
Figure 2:
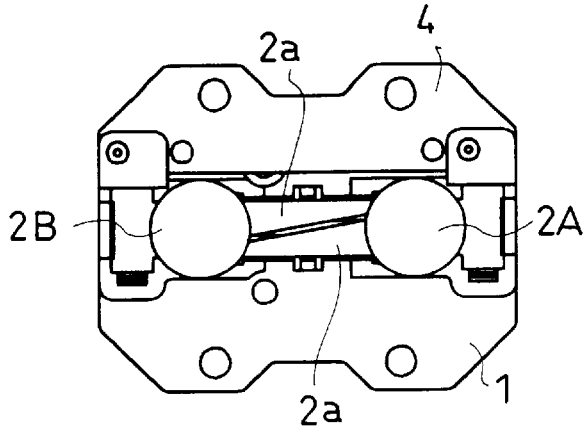
FIG. 2 shows the same push-button switch, FIG. 2(*a*) being a plan view, FIG. 2(*b*) a front elevation, FIG. 2(*c*) a bottom view, and FIG. 2(*d*) a side view.
Figure 2:
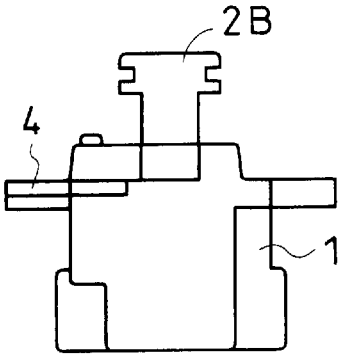
Figure 2:
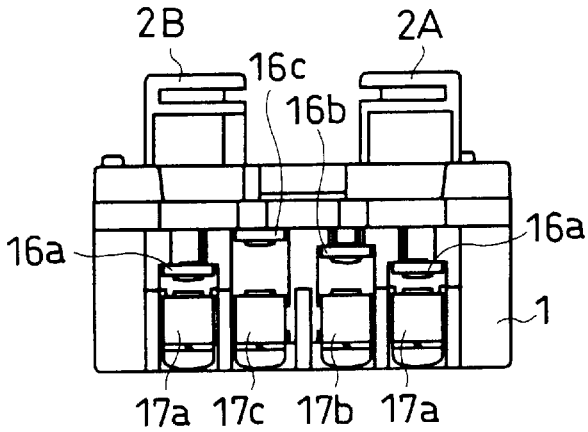
Figure 2:
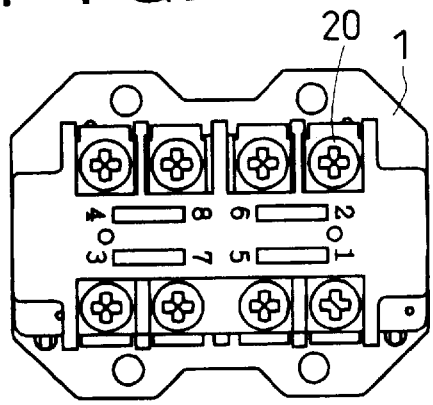

Embodiments of the interlocking device for a push-button switch according to the present invention will be explained hereafter based on drawings.

FIG. 1 to FIG. 9 indicate the first embodiment in which the interlocking device for a push-button switch according to the present invention is applied to a three-stage push-button switch used for the operation of cranes and hoists.

This three-stage push-button switch is mainly composed of a spring fixing base 4 fastened to the switch body 1 by a screw 15, two push buttons 2A, 2B and a mobile contact base 3 for second and third stages inserted in a housing groove 1*a* formed on the switch body 1, an interlocking member 5 for mobile contact and an interlocking member 6 for the push button constituting the interlocking device provided at a position lower than the push buttons 2A, 2B, a push button returning spring 7 provided between the contact base 1 and the push buttons 2A, 2B, a mobile contact base returning spring 8 provided between the contact base 1 and the mobile contact base 3 for second and third stages, and four pairs of fixed contacts 17 and terminal screw 20 for wiring provided at the lower part of the switch body 1.

On the switch body 1, a required number of mobile contact housing windows 1*b* are drilled, and in which are inserted mobile contacts 16 provided on the push buttons 2A, 2B and the mobile contact base 3 for second and third stages.

On the push buttons 2A, 2B are provided steel balls 14, 14 urged by spring 13 constituting a clip mechanism, while on one side of the wall face of the housing groove 1*a* formed, on the switch body 1 on which the push buttons 2A, 2B slide, is provided, a spring 12 facing the steel balls 14 and locked in a state in phase between the switch body 1 and the spring fixing base 4, and on the other side is formed a stepped part (not illustrated) facing the steel ball 14, so that, when the push buttons 2A, 2B are pressed down, it becomes possible to clip the push button at three stages at the prescribed pressed down position, by fitting one steel ball 14 in the gap of the spring 12 and fastening the other steel ball 14 at the stepped part.

In this case, since the clipping position of the push buttons 2A, 2B is determined by the pitch of the spring 12 and the pitch of the stepped part, (this section) will be constructed in such a way that the spring 12 agrees with the pitch of the stepped part.

Moreover, the push buttons 2A, 2B are provided, on their side face, with a projection 2*a* for pressing down the mobile contact base 3 for second and third stages provided between the two push buttons 2A, 2B, and form a mobile contact housing window 2*b* in which is inserted a mobile contact 16*a* for the first stage.

And, the mobile contact 16*a* for the first stage inserted in the mobile contact housing window 2*b* of the push buttons 2A, 2B is urged downwardly by a mobile contact spring 9 for the first stage provided between the mobile contact 16*a* for the first stage and the two push buttons 2A, 2B.

And, the push buttons 2A, 2B are inserted in the housing groove 1*a* of the switch body 1, in a locked state, as the mobile contact 16*a* for the first stage comes in contact with the top face of the mobile contact housing windows 1*b* drilled in the switch body 1.

The mobile contact base 3 for the second and third stages provided between the two push buttons 2A, 2B, made of the same material as that of the push buttons 2A, 2B, is pressed downwardly together with the push buttons 2A, 2B by a projection 2*a* provided on the push buttons 2A, 2B, as either one of the two push buttons 2A, 2B is pressed down.

On the body of the mobile contact base 3 for the second and third stages are formed a mobile contact housing window 3*a*, in which is inserted the mobile contact 16*b* for the second stage, and a mobile contact housing window 3*b*, in which is inserted the mobile contact 16*c* for the third stage.

The mobile contact 16*b* for the second stage and the mobile contact 16*c* for the third stage inserted in the mobile contact housing window 3*a* and the mobile contact housing window 3*b* respectively are urged downwardly by either a mobile contact spring 10 for the second stage or a mobile contact spring 11 for the third stage provided between the mobile contact 16*b* for the second stage or the mobile contact 16*c* for the third stage and the mobile contact base 3 for the second and third 3rd stages.

And, the mobile contact base 3 for the second and third stages is inserted in the housing groove 1*a* of the switch body 1, in a locked state, as the mobile contact 16*b* for the second stage or the mobile contact 16*c* for the third stage comes in contact with the top face of the mobile contact housing windows 1*b* drilled in the switch body 1.

The four pairs of fixed contacts 17*a*, 17*a*, 17*b*, 17*c* provided at the lower part of the switch body 1 in a way to face the mobile contacts 16 are constituted by forming an upward facing contact part at the upper piece of the fixed contact pieces in a U shape, and the bottom piece of the respective fixed contact pieces being connected by a terminal screw 20 for wiring.

Figures 3, 4:
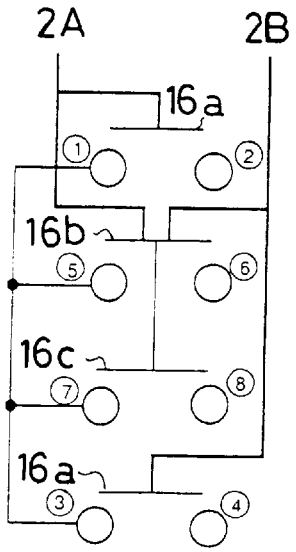
FIG. 3 is a circuit diagram of the same push-button switch.
FIG. 4 is a drawing showing the relationship between push buttons and output of the same push-button switch.

FIG. 4 indicates the output of the four pairs of terminal ($\hat{1}$–$\hat{2}$, $\hat{3}$–$\hat{4}$, $\hat{5}$–$\hat{6}$, $\hat{7}$–$\hat{8}$) in the case where the two push buttons 2A, 2B are pressed down to the first stage, second stage, and third stage respectively, i.e., when the closing of the fixed contact 17*a* by mobile contact 16*a* for the first stage, the closing of the fixed contact 17*b* by mobile contact 16*b* for the second stage, and the closing of the fixed contact 17*c* by mobile contact 16*c* for the third stage are made sequentially.

In this way, the three-stage push-button switch of this embodiment is realized in a way to cover the output when two push buttons 2A, 2B are pressed down to the first stage, second stage, and third stage respectively. It is to be noted, however, that the closing of the fixed contact 17*b* by mobile contact 16*b* for the second stage and the closing of the fixed contact 17*c* by mobile contact 16*c* for the third stage are common to the two push buttons 2A, 2B. By combining the output of the four pairs of terminals as required at the interface, reduction of size, simplification of wiring and cost reduction of the push-button switch are realized.

The interlocking member 5 for mobile contact constituting the interlocking device, swingably provided on the switch body 1 at a position lower than the two push buttons 2A, 2B, with approximately the mid-point of two push buttons as a fulcrum through a spindle 18, is designed in a way to prevent closing of the mobile contact 16*a* for the first stage of at least one push button as the bottom face of the mobile contact 16*a* for the first stage of the push buttons 2A, 2B touches at its contact point when the two push buttons are pressed downwardly.

This interlocking member 5 for mobile contact, constitutes an interlocking device of the push-button switch and prevents closing of the mobile contact 16*a* for the first stage of at least one push button as the bottom face of the mobile contact 16*a* for the first stage of the push buttons 2A, 2B touches at its contact point when the two push buttons are pressed downwardly, can secure a large freedom of relative operating range between the two push buttons and the interlocking member 5 for mobile contact and, therefore, secure a sufficient stroke in each stage of the push buttons 2A, 2B.

Figure 6:
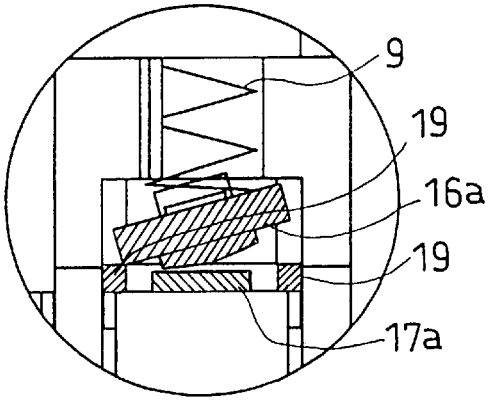
FIG. 6 is an explanatory drawing of the contact state between the mobile contact for the first stage and the fixed contact, FIG. 6(*a*) showing a case where ribs for supporting the side edges of the mobile contact for first stage are provided on the switch body, and FIG. 6(*b*) a case where no such ribs are provided.
Figure 6:
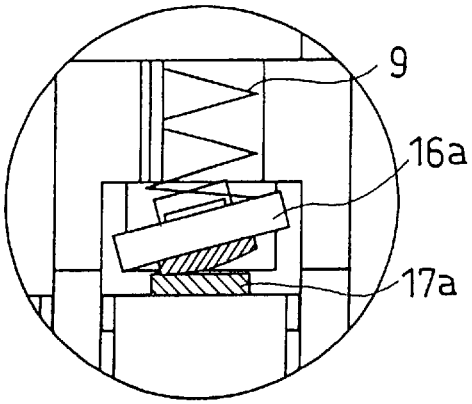

Also, the mobile contact 16*a* for the first stage, the bottom face of which comes in contact with the interlocking member 5 for mobile contact with pressing down of the two push buttons 2A, 2B, is liable to incline, as shown in FIG. 6(*b*), and this may eventually produce a situation in which the protective effects against closing of the mobile contact 16*a* for the first stage to be essentially obtained are not achieved.

Figure 5:
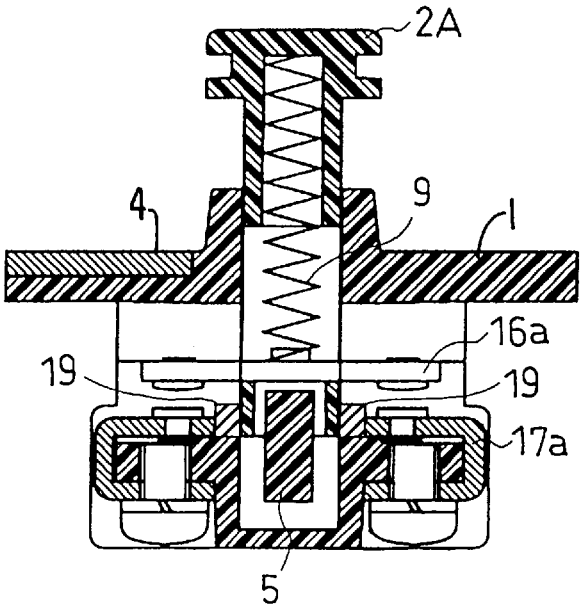
FIG. 5 shows a push-button switch provided, on the switch body, with ribs for supporting the side edges of the mobile contact for the first stage, FIG. 5(*a*) being a sectional side elevation, and FIG. 5(*b*) a front elevation (main part).
Figure 5:
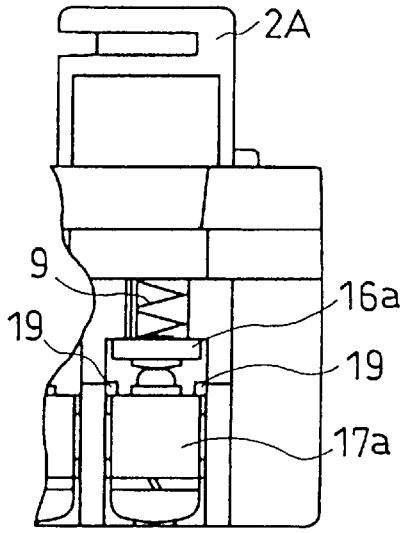

To cope with this problem, a rib 19 supporting the side edge of the mobile contact 16*a* for the first stage pressed down in an inclined state is provided in a projection on the switch body 1 around the fixed contact 17*a* disposed in a way to face the mobile contact 16*a* for the first stage, as shown in FIG. 5 and FIG. 6(*a*), to thereby accurately prevent the mobile contact 16*a* for the first stage from closing the fixed contact 17*a* in an inclined state.

Figure 7:
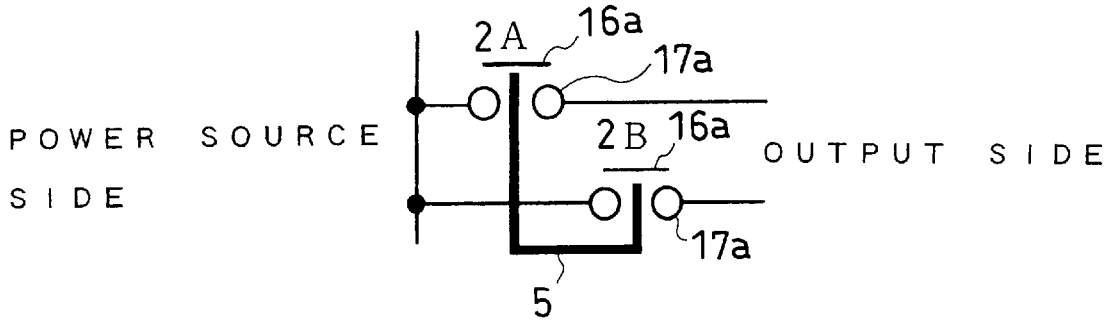
FIG. 7 is a schematic diagram of the contact state between the mobile contact for the first stage and the fixed contact, FIG. 7(*a*) showing a case where the push button is not pressed downwardly, and FIG. 7(*b*) a case where the push button is pressed downwardly.
Figure 7:
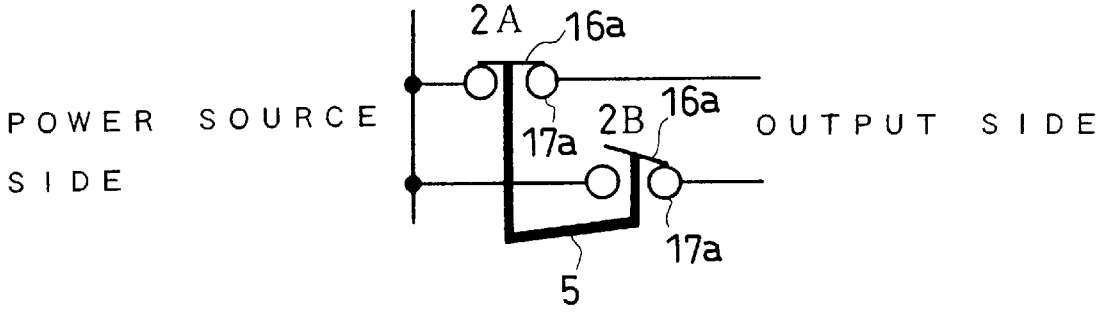

Moreover, the mobile contact 16*a* for the first stage, the bottom face of which is in contact with the interlocking member 5 for mobile contact, has a risk of touching the fixed contact 17*a* on one side in inclined state as shown in FIG. 7(*b*) and this may eventually produce a situation in which the protective effects against closing of the mobile contact 16*a* for the first stage to be essentially obtained are not achieved, when the interlocking member 5 for mobile contact is formed with a conductive material.

To cope with this problem, the interlocking member 5 for mobile contact is formed with an insulating material such as synthetic resin, etc. so as to accurately prevent closing of the fixed contact 17*a* in an inclined state, even when the mobile contact 16*a* for the first stage touches the fixed contact 17*a* on one side in an inclined state.

The interlocking device can be constructed simply with this interlocking member 5 for mobile contact but shall preferably be also supplemented with an interlocking device 6 for push button.

The interlocking device 6 for push button is swingably provided on the switch body 1 at a position lower than the two push buttons 2A, 2B, with approximately the mid-point of two push buttons 2A, 2B as a fulcrum through a spindle 18 which is common to the interlocking member 5 for mobile contact, so as to prevent the push buttons 2A, 2B from being pressed down by no less than two stages at a time by contact of the bottom face 2*c* of the push buttons 2A, 2B, in case of any pressing down by no less than two stages of the push buttons 2A, 2B.

In this embodiment, two interlocking devices 6, 6 are disposed on both sides of the interlocking member 5 for mobile contact so that the interlocking device 6 may come in contact evenly with and support the bottom face 2*c* of the push buttons 2A, 2B. However, the interlocking device 6 does not need to be two pieces, and it is also possible to integrally form the interlocking device 6 and the spindle 18.

Because the interlocking device 6 is designed to prevent the two push buttons 2A, 2B from being pressed down by no less than two stages at a time, this makes it possible to prevent the push buttons 2A, 2B, which are opened by the action of the interlocking member 5 for mobile contact, from being suddenly closed in the state pressed down by no less than two stages, by releasing the pressing down operation of the other push button.

Furthermore, by preventing the two push buttons 2A, 2B from being pressed down by no less than two stages at a time, it becomes possible to prevent the application of any large external force to the interlocking member 5, and improve the durability of the interlocking member 5 which shall preferably be formed with an insulating material such as synthetic resin, etc., for the above-mentioned reason.

In this case, the interlocking device 6 is constructed in a way to cause contact of the push buttons 2A, 2B when the push buttons are pressed down by no less than two stages, and this helps to avoid actualization of the defect of an interlocking member for push buttons which cannot secure a large freedom of relative operating range, and secure a sufficient stroke in each stage of the push buttons 2A, 2B.

Next, explanation will be made on the actions of this interlocking device.

Figure 8:
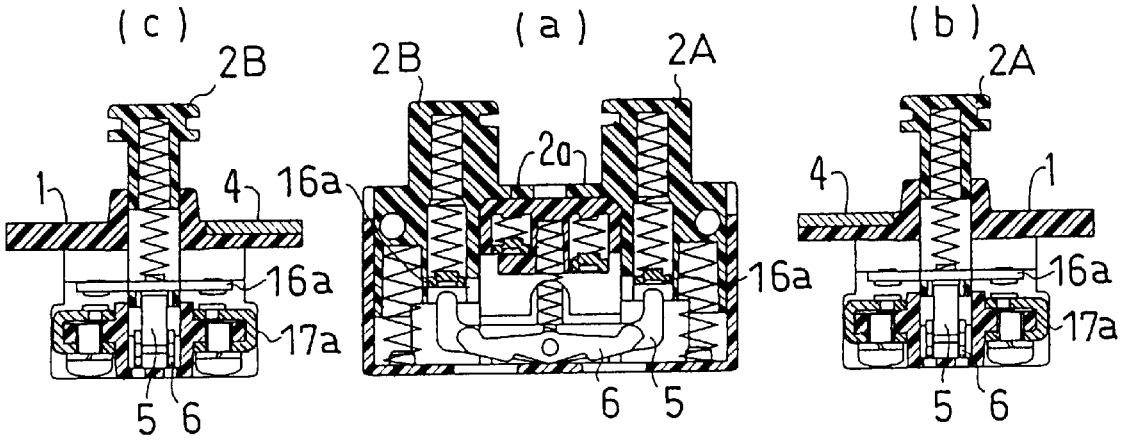
FIG. 8 is an explanatory drawing of the working state of the push-button switch shown in FIG. 1, FIG. 8(*i*) showing a state in which the push buttons are not pressed downwardly, and FIG. 8(*ii*) a state in which the two push buttons are pressed downwardly by one stage. Here, (a) is a sectional plan view, (b) a sectional right side elevation, and (c) a sectional left side elevation.
Figure 8:
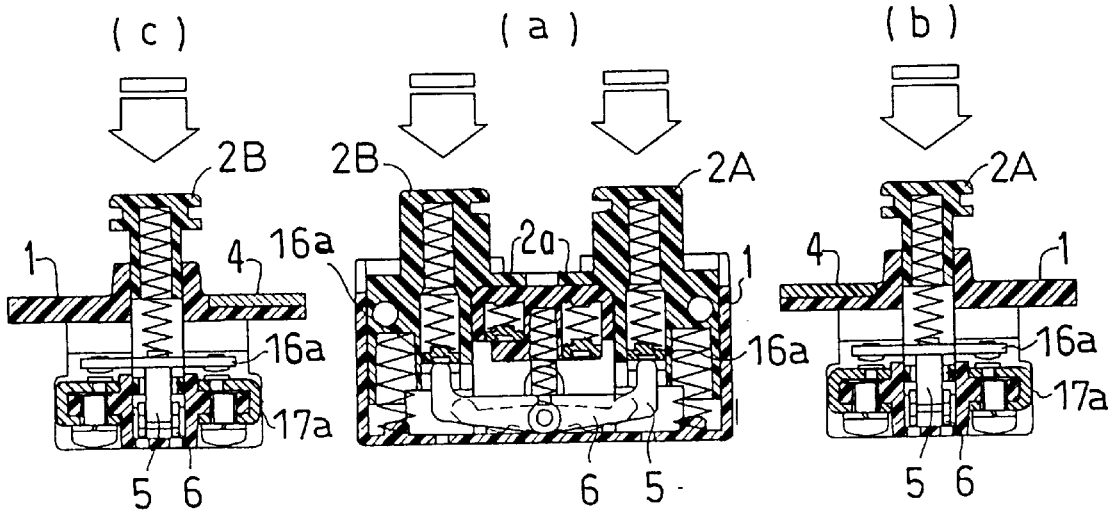

In the case where the two push buttons 2A, 2B are pressed down by one stage at a time (FIG. 8(*ii*)) from the state in which the push buttons 2A, 2B are not pressed down (FIG. 8(*i*)), closing of the mobile contact 16*a* for the first stage of at least one push button can be prevented, as the bottom face of the mobile contact 16*a* for the first stage of the push buttons 2A, 2B comes in contact with the interlocking member 5 for mobile contact.

Figure 9:
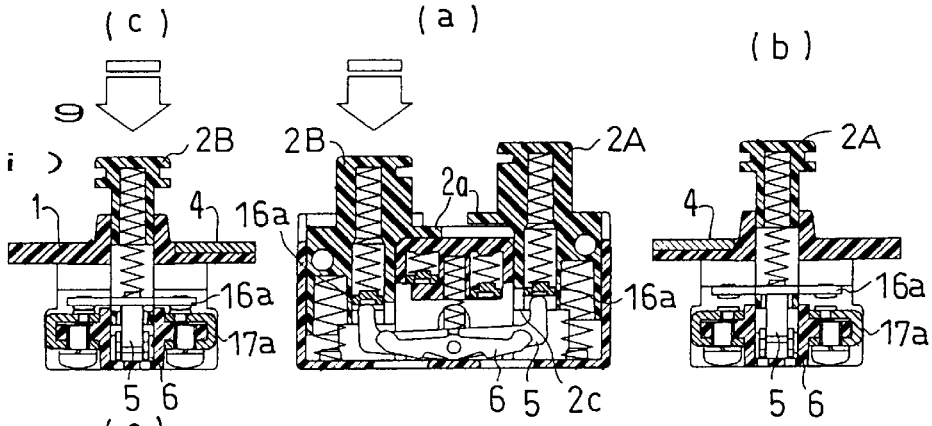
FIG. 9 is an explanatory drawing of the working state of the push-button switch shown in FIG. 1, FIG. 9(*i*) showing a state in which one push button is pressed downwardly by one stage, FIG. 9(*ii*) a state in which one push button is pressed downwardly by two stages, and FIG. 9(*iii*) a state in which one push button is pressed downwardly by three stages. Here, (a) is a sectional plan view, (b) a sectional right side elevation, and (c) a sectional left side elevation.
Figure 9:
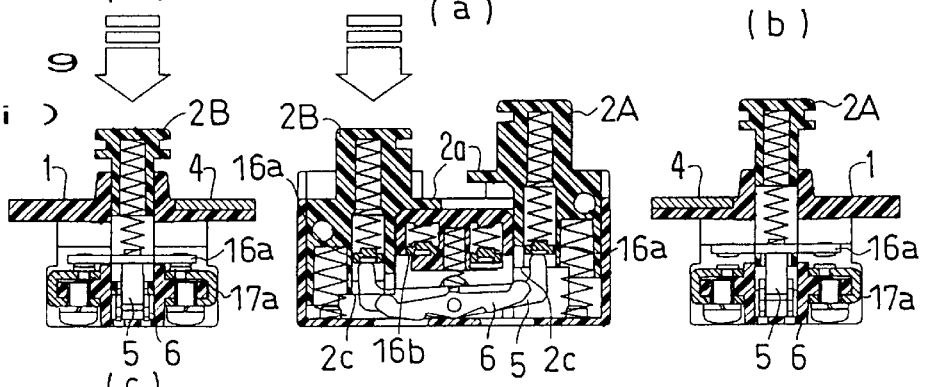
Figure 9:
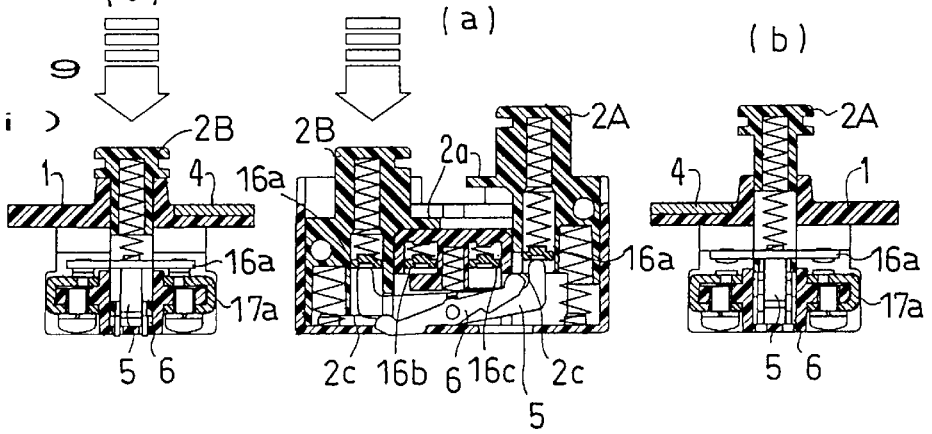
Figure 10:
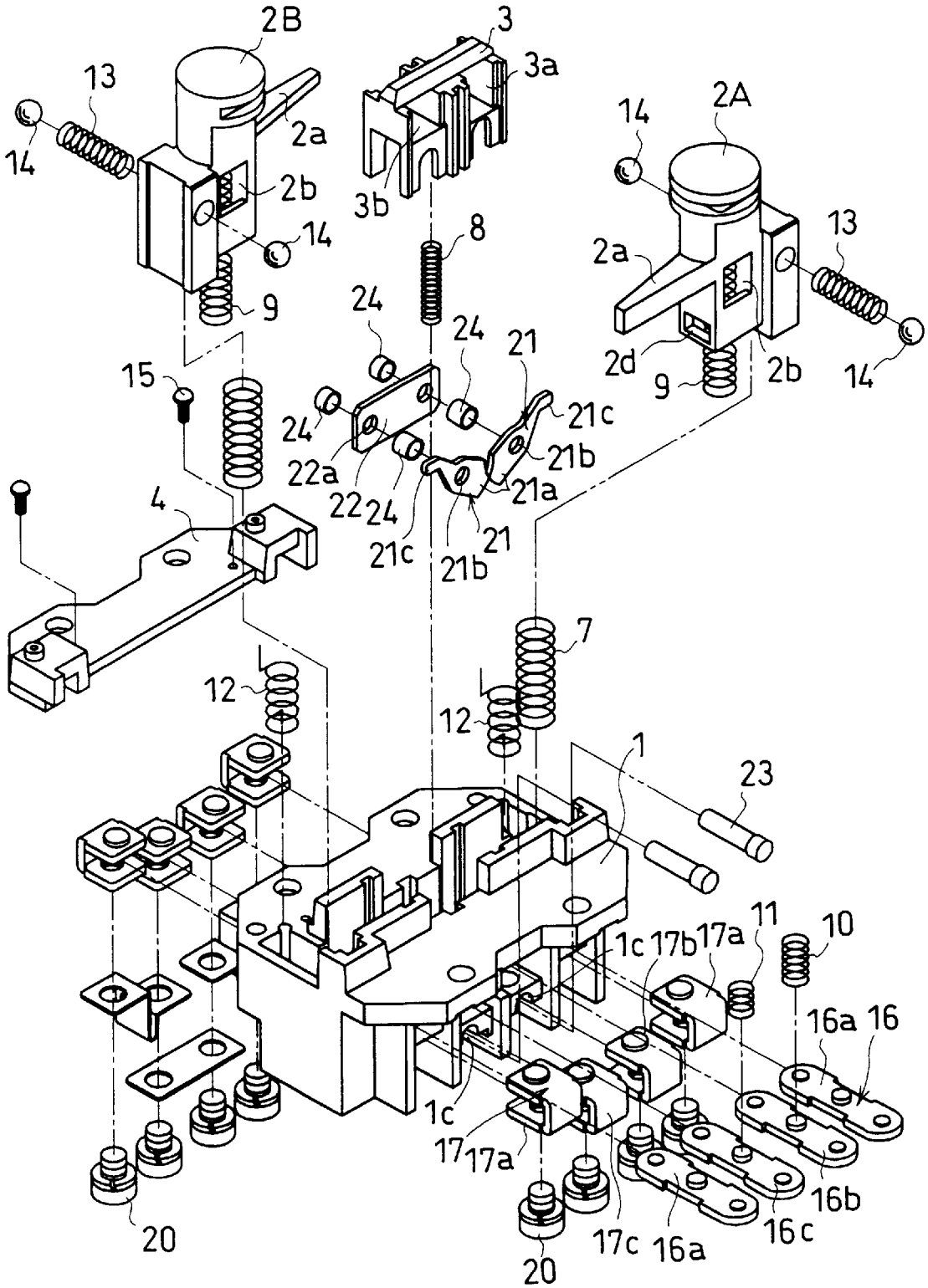
FIG. 10 is an exploded perspective view showing the second embodiment of a push-button switch including the interlocking device according to the present invention.
Figure 11:
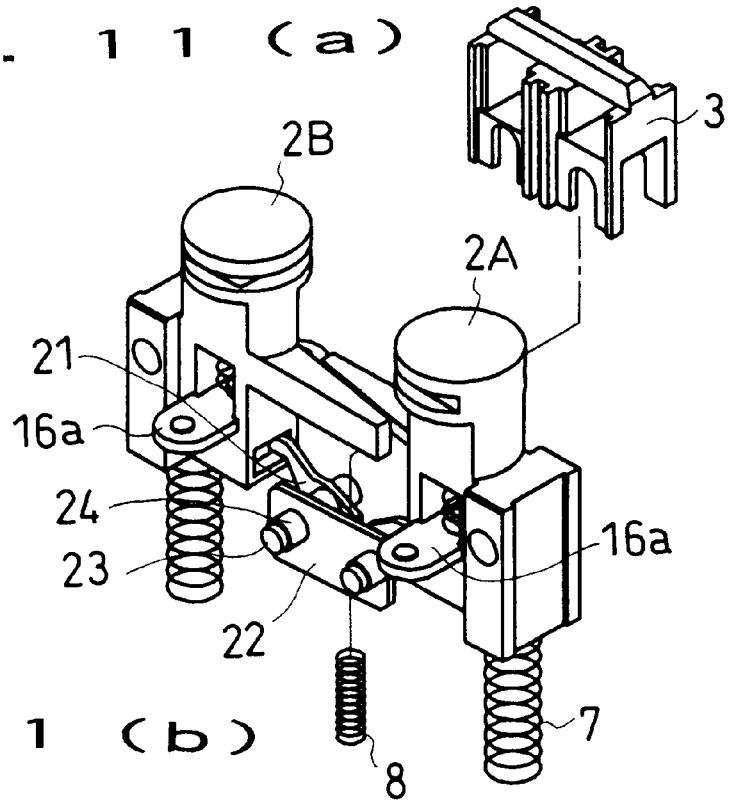
FIG. 11 is an exploded perspective view of the main part of the same push-button switch.
Figure 11:
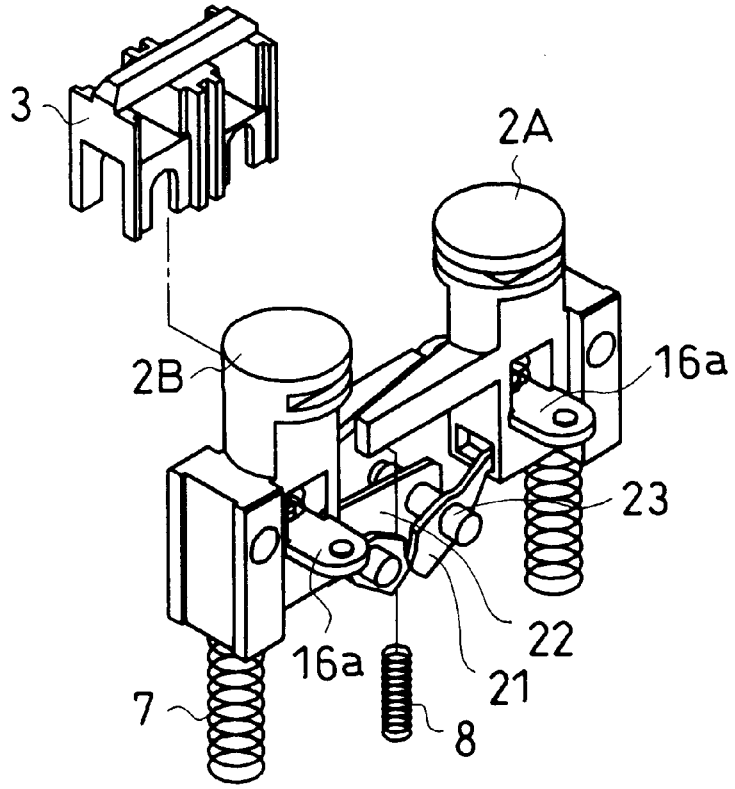

On the other hand, when one of the two push buttons 2A, 2B (push button 2B in the illustrated case) is pressed down by one stage, as shown in FIG. 9, from the state in which the push buttons 2A, 2B are not pressed down (FIG. 8(*i*)), the bottom face of the mobile contact 16*a* for the first stage of the push button 2B comes in contact with the interlocking member 5 for mobile contact but, since the other push button 2A is not pressed down, the interlocking member 5 for mobile contact swings around the spindle 18, while the mobile contact 16*a* for the first stage of the push button 2B is pressed downwardly and closes the fixed contact 17*a* (FIG. 9(*i*)).

When, from this state, the push button 2B is further pressed down (pressing down by 2 stages), the mobile contact base 3 for the second and third stages is pressed down by the projection 2*a* of the push button 2B with the fixed contact 17*a* closed by the mobile contact 16*a* for the first stage, and the mobile contact 16*b* for the second stage provided on the mobile contact base 3 for the second and third stages closes the fixed contact 17*b* (FIG. 9(*ii*)).

At this time, the bottom face 2*c* of the push button 2B comes in contact with the interlocking member 6, and the interlocking member 6 swings around the spindle 18, to thereby prevent the push button 2A from being pressed down by no less than two stages at a time. At this time, it is possible to press down the push button 2A by one stage only, but closing of the mobile contact 16*a* for the first stage of the push button 2A is prevented by the action of the interlocking member 5 for mobile contact, as mentioned above.

When, from this state, the push button 2B is further pressed down (pressing down by 3 stages), the mobile contact base 3 for the second and third stages is pressed down by the projection 2*a* of the push button 2B with the fixed contact 17*a* closed by the mobile contact 16*a* for the first stage and the fixed contact 17*b* closed by the mobile contact 16*b* for the first stage, and the mobile contact 16*c* for the third stage provided on the mobile contact base 3 for the second and third stages closes the fixed contact 17*c* (FIG. 9(*iii*)).

At this time, the interlocking member 6 is further swung around the spindle 18 and comes in contact with the bottom face 2*c* of the push button 2B, to thereby prevent the push button 2A from being pressed down by no less than one stage at a time.

FIG. 10 to FIG. 16 illustrate the second embodiment in which the interlocking device for a push-button switch according to the present invention is applied to a three stage push-button switch used for the operation of cranes and hoists.

The push-button switch of this embodiment has the same construction as that of the first embodiment except for the interlocking device and, therefore, explanation will be given on the interlocking device hereafter.

The interlocking members 21 for the push-button constituting the interlocking device are provided facing each other on the switch body 1 at a position lower than two push buttons 2A, 2B, in correspondence to the push buttons 2A, 2B, in a way to be swingable, though a spindle 23, synchronizing with pressing down of the push buttons 2A, 2B when the push buttons are pressed downwardly, and a projection 21*a* for preventing swinging of the other interlocking member 21 (i.e., preventing the swinging of the two interlocking members 21 when the two push buttons 2A, 2B are pressed), is formed on the interlocking member 21 at the portion where the two interlocking members 21 face each other, thus preventing any simultaneous pressing down of the two push buttons 2A, 2B.

These interlocking members 21 constitute an interlocking device of the push-button switch and prevent the two push buttons 2A, 2B from being pressed down simultaneously, by swinging the respective interlocking members 21 independently of each other synchronizing with the pressing down of the push buttons 2A, 2B when the two push buttons 2A, 2B are pressed downwardly, can secure a large freedom of relative operating range between the two push buttons and the interlocking members 21 and, therefore, secure a sufficient stroke in each stage of the push buttons 2A, 2B.

Figure 12:
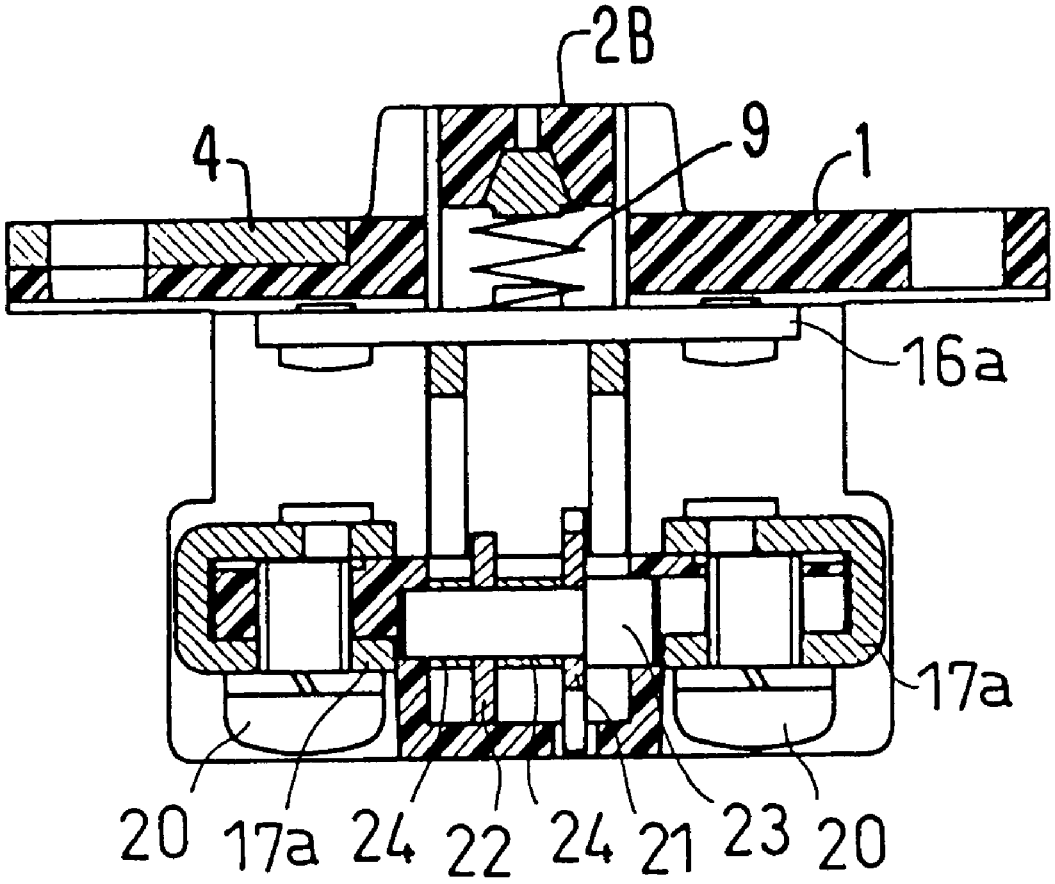
FIG. 12 is a sectional side elevation of the main part of the same push-button switch.

In this embodiment, the interlocking members 21 are swingably supported by a spindle 23 inserted through a spindle inserting hole 1*c* formed on the switch body 1, as shown in FIG. 12. This interlocking device is assembled by first disposing the interlocking members 21 for push button, a reinforcing plate 22 and spacers 24, 24 at prescribed positions on the switch body 1, inserting the spindle 23 through the spindle through hole 1*c* formed on the switch body 1, in a way to pass through the through holes 21*b*, 22*a* formed on the interlocking members 21 and the reinforcing plate 22 respectively, and then locking the spindle 23 by fastening the fixed contacts 17*b*, 17*c* by terminal screws 20 for wiring.

Moreover, a projection 21*c* is formed on the interlocking member 21 at the portion where the interlocking members 21 face the push buttons 2A, 2B, and this projection 21*c* is inserted in the projection inserting hole 2*d* formed in the push buttons 2A, 2B to swing the interlocking members 21 through the spindle 23 synchronizing with the pressing down operation of the push buttons 2A, 2B, and swinging the other interlocking members 21 in the direction opposite to the direction of swinging in the case of pressing down of the push buttons 2A, 2B, through the spindle 23 and synchronizing with the upward movement of the push buttons 2A, 2B, by cancelling the pressing down of the push buttons 2A, 2B, to return to the initial state.

Next, actions of this interlocking device will be explained hereafter.

Figure 13:
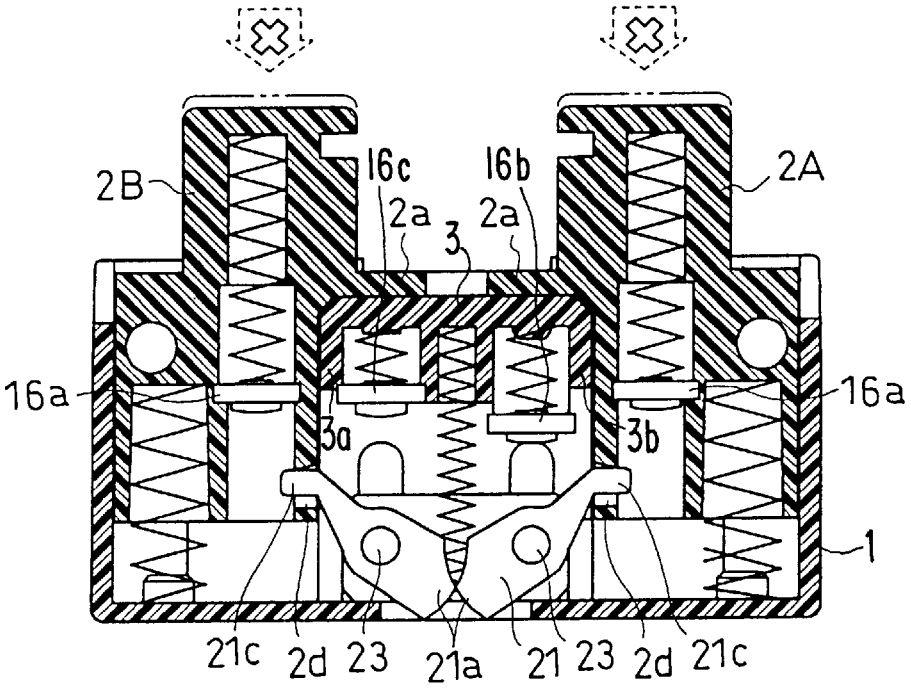
FIG. 13, which is an explanatory drawing of the working state of the push-button switch shown in FIG. 10, is a sectional front elevation showing a state in which an attempt is made to press the two push buttons downwardly.

When the two push buttons 2A, 2B are pressed down simultaneously, as shown in FIG. 13, from the state in which the push buttons 2A, 2B are not pressed down, the projections 21*a* of the two interlocking members 21 come in contact with each other to prevent swinging of the interlocking members 21, thereby preventing the push buttons 2A, 2B from being pressed down simultaneously.

Figure 14:
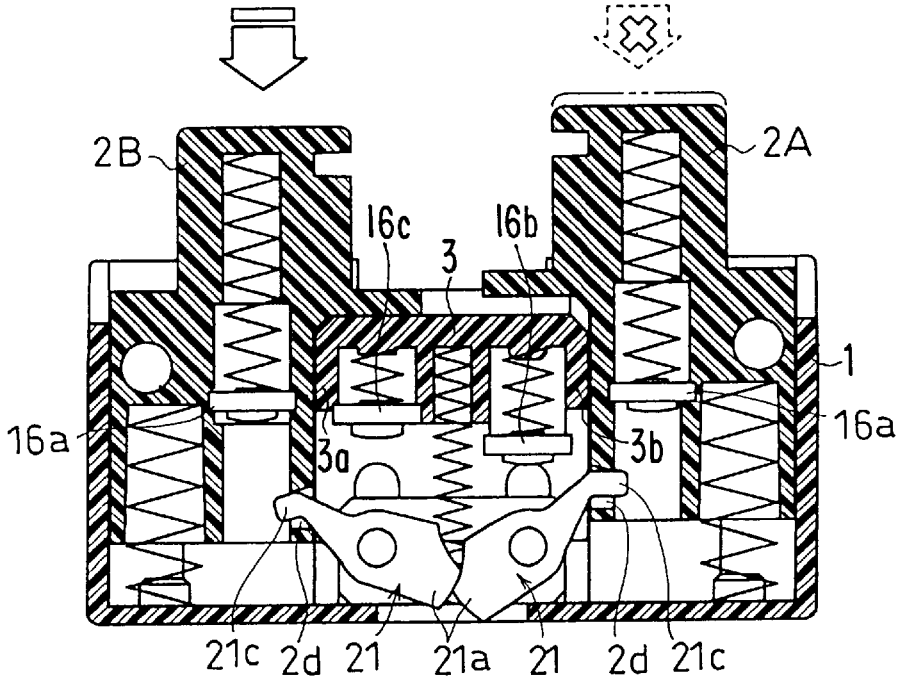
FIG. 14, which is an explanatory drawing of the working state of the push-button switch shown in FIG. 10, is a sectional front elevation showing a state in which one push button is pressed downwardly by one stage.
Figure 15:
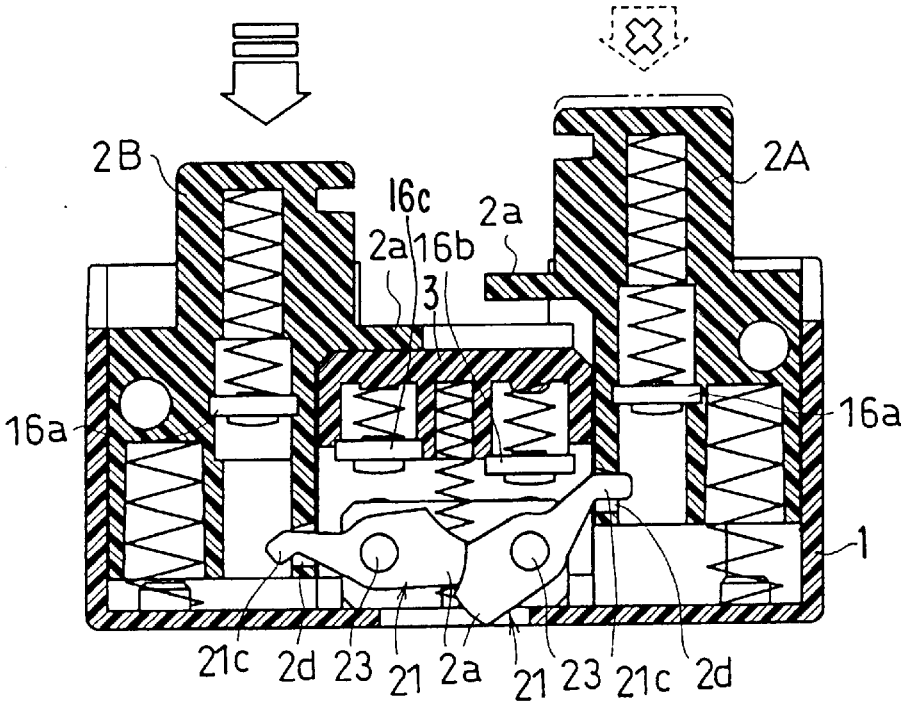
FIG. 15, which is an explanatory drawing of the working state of the push-button switch shown in FIG. 10, is a sectional front elevation showing a state in which one push button is pressed downwardly by two stages.
Figure 16:
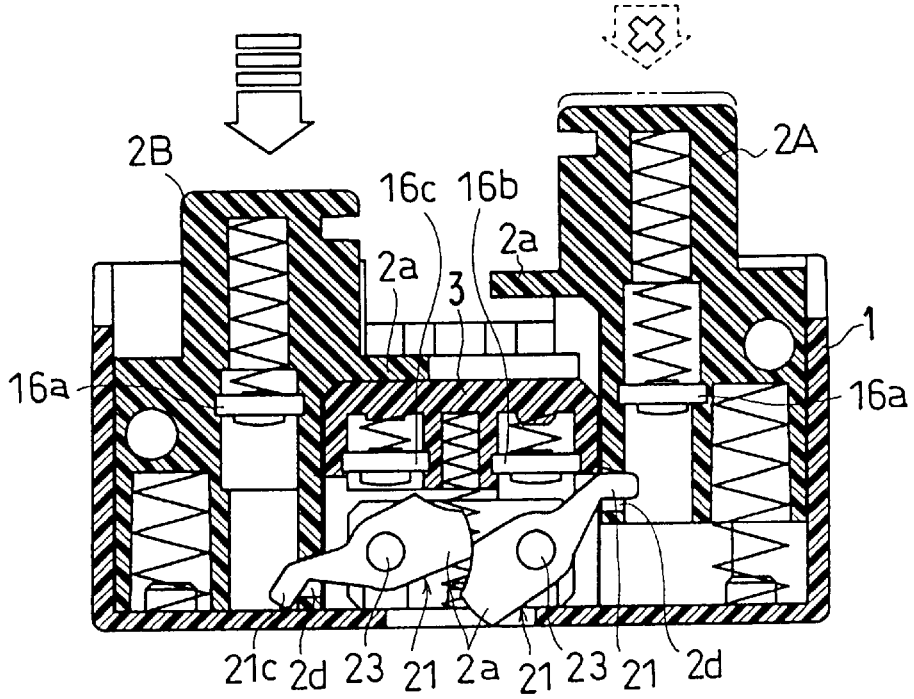
FIG. 16, which is an explanatory drawing of the working state of the push-button switch shown in FIG. 10, is a sectional front elevation showing a state in which one push button is pressed downwardly by three stages.

On the other hand, when one of the two push buttons 2A, 2B (push button 2B in the illustrated case) is pressed down, as shown in FIG. 14 to FIG. 16, from the state in which the push buttons 2A, 2B are not pressed down, the interlocking members 21 swing synchronizing with the pressing down operation of the push button 2B, and the push button 2B can be pressed down sequentially to the first stage (FIG. 14), second stage (FIG. 15) and third stage (FIG. 16).

At this time, if any attempt is made to also press down the other push button 2A at the same time, the projection 21*a* of the interlocking member 21 of the push button 2A comes in contact with the projection 21*a* of the interlocking member 21 of the push button 2B to prevent swinging of the interlocking member 21 of the push button 2A, thereby preventing pressing down of the push buttons 2A.

The interlocking device for a push-button switch according to the present invention has so far been explained based on embodiments in which it is applied to a three-stage push-button switch used for the operation of cranes and hoists. This three-stage push-button switch can utilize, usually, a contact signal of single-stage pressing down of push buttons 2A, 2B as an operating signal and utilize a contact signal of two-stage and two-stage pressing down of push buttons 2A, 2B as control signal for controlling equipment speed.

Moreover, a three-stage push-button switch realized by applying the interlocking device for a push-button switch according to the present invention can also be applied widely to push-button switches other than those of the embodiments, in the range not deviating from the object of that switch.

I claim:

1. An interlocking device for a push button switch, the push button switch including a switch body with fixed contacts, the push button switch having first and second push buttons which are downwardly movable in multiple stages by being pressed, each of the first and second push buttons having mobile contacts, said interlocking device comprising:

a mobile contact interlocking member for preventing the contact of a mobile contact of at least one of the push buttons with a corresponding fixed contact when the first and second push buttons are pressed down simultaneously;

said mobile contact interlocking member being provided on the switch body so that said mobile contact interlocking member swings on the switch body at a position which is relatively lower that the first and second push buttons; and said mobile contact interlocking member being connected to the switch body at approximately a mid-point between the first and second push buttons.

2. The interlocking device as described in claim 1 further comprising:

an interlocking member for preventing closing of the push buttons and for preventing the push buttons from being simultaneously pressed down by no less than two stages;

said interlocking member being provided on the switch body so that said interlocking member swings on the switch body at a position which is relatively lower that the first and second push buttons; and said interlocking member being connected to the switch body at approximately a mid-point between the first and second push buttons.

3. An interlocking device for a push button switch, the push button switch including a switch body with fixed contacts, the push button switch having first and second push buttons which are downwardly movable in multiple stages by being pressed, each of the first and second push buttons having mobile contacts, said interlocking device comprising:

a first interlocking member corresponding to the first push button, said first interlocking member including a projection;

a second interlocking member corresponding to the second push button, said second interlocking member including a projection; and said first and second interlocking members facing each other and being synchronizingly swingable when the push buttons are pressed down; wherein when one of the push buttons is pressed down, said projection of the interlocking member corresponding to the pressed down push button prevents the swinging of the other interlocking member thereby preventing any simultaneous pressing down of the push buttons.

4. A push button switch comprising:

a switch body with fixed contacts;

first and second push buttons which are downwardly movable in multiple stages by being pressed, each of said first and second push buttons having mobile contacts;

an interlocking device comprising a mobile contact interlocking member for preventing the contact of a mobile contact of at least one of said push buttons with a corresponding fixed contact when said first and second push buttons are pressed down simultaneously;

said mobile contact interlocking member being provided on said switch body so that said mobile contact interlocking member swings on said switch body at a position which is relatively lower that said first and second push buttons; and said mobile contact interlocking member being connected to said switch body at approximately a mid-point between said first and second push buttons.

5. The push button switch as described in claim 4, wherein the interlocking device further comprises:

an interlocking member for preventing closing of said push buttons and for preventing said push buttons from being simultaneously pressed down by no less than two stages;

said interlocking member being provided on said switch body so that said interlocking member swings on said switch body at a position which is relatively lower that said first and second push buttons; and said interlocking member being connected to said switch body at approximately a mid-point between said first and second push buttons.

6. A push button switch comprising:

a switch body with fixed contacts;

first and second push buttons which are downwardly movable in multiple stages by being pressed, each of said first and second push buttons having mobile contacts;

an interlocking device comprising a first interlocking member corresponding to said first push button, said first interlocking member including a projection;

a second interlocking member corresponding to said second push button, said second interlocking member including a projection; and said first and second interlocking members facing each other and being synchronizingly swingable when said push buttons are pressed down; wherein when one of said push buttons is pressed down, said projection of the interlocking member corresponding to the pressed down push button prevents the swinging of the other interlocking member thereby preventing any simultaneous pressing down of said push buttons.

* * * * *